United States Patent [19]

Kudo et al.

[11] Patent Number: 4,486,742

[45] Date of Patent: Dec. 4, 1984

[54] MULTIFREQUENCY PIEZOELECTRIC HORN SYSTEM

[75] Inventors: Michio Kudo; Tatsuo Fukami; Rinpei Hayashibe, all of Naganoken, Japan

[73] Assignee: Marukokeihouki Co. Ltd., Naganoken, Japan

[21] Appl. No.: 306,830

[22] Filed: Sep. 29, 1981

[30] Foreign Application Priority Data

Nov. 10, 1980 [JP] Japan ..... 55-160581[U]
Nov. 10, 1980 [JP] Japan ..... 55-160582[U]
Jan. 30, 1981 [JP] Japan ..... 56-13086[U]

[51] Int. Cl.[3] ..... G08B 3/00

[52] U.S. Cl. ..... 340/384 E; 310/324; 340/388

[58] Field of Search ..... 340/388, 384 E; 310/324, 317, 316

[56] References Cited

U.S. PATENT DOCUMENTS 4,104,628 8/1978 Sweany et al. ..... 340/384 E
4,139,842 2/1979 Fujita et al. ..... 340/384 E
4,159,472 6/1979 Murakami et al. ..... 340/388

*Primary Examiner*—Glen R. Swann, III
*Attorney, Agent, or Firm*—Jordan and Hamburg

[57] ABSTRACT

A multifrequency piezoelectric sound-generating system is provided with a piezoelectric vibrator for generating audible sound at two or more resonance frequencies, an oscillator circuit connected to the piezoelectric vibrator for oscillating at one of the resonance frequencies, and a modulator circuit connected to the oscillator circuit for amplitude-modulating the oscillator circuit with a modulating frequency substantially equal or close to a frequency separation between the resonance frequencies to energize the piezoelectric vibrator with frequency-modulated waves to generate multifrequency audible sound.

The modulator circuit may have a frequency divider that is operative in response to an oscillating frequency in the oscillator circuit for dividing or counting down the oscillating frequency into the modulating frequency to modulate the oscillator circuit therewith. The piezoelectric vibrator may include a diaphragm, a generally rectangular metal sheet which is smaller in size than the diaphragm and mounted on the diaphragm, and a sheet of a piezoelectric material mounted on the metal sheet.

10 Claims, 16 Drawing Figures

MULTIFREQUENCY PIEZOELECTRIC HORN SYSTEM

BACKGROUND OF THE INVENTION

1. Field of the Invention

This invention relates to a multifrequency piezoelectric horn system, and, particularly, to an electronic horn including a piezoelectric vibrator for generating audible sound and for use in automobiles.

2. Description of the Prior Art

In automobiles, electromagnetic horns have commonly been used which include an electromagnetic mechanism, which may cause the horns to be heavy and massive, to consume electric power remarkably, and to be a source of noises, such as surge voltage, to electronics involved in the cars in which the electromagnetic horns are equipped.

Piezoelectric vibrators or sound generators, such as buzzers, generate simple harmonic acoustic waves at the range of two or three kilohertz, which may not be comfortable to the ear. With commonly available piezoelectric buzzers, the sound energy level of 90 db was measured at the distance of one meter in front of them. Both tone and energy level of the sound were therefore not suitable for horns for use in automobiles. For electronic horns for use in cars, it is required to generate audible sound of a broader bandwidth giving a sufficient sound pressure to other cars and pedestrains around the cars.

It is therefore an object of the present invention to provide a multifrequency piezoelectric horn system which is light, consumes small electric power, nor is harmful to other electronics.

It is another object of the invention to provide a multifrequency piezoelectric horn system which generates audible sound having sufficiently suitable tone and energy level for automobiles.

SUMMARY OF THE INVENTION

In accordance with the present invention, those and other objects are accomplished by multifrequency piezoelectric sound-generating apparatus comprising a piezoelectric vibrator for generating audible sound at at least two distinct resonance frequencies, an oscillator circuit connected to said piezoelectric vibrator for oscillating at one of the resonance frequencies, and a modulator circuit connected to said oscillator circuit for amplitude-modulating said oscillator circuit with a modulating frequency substantially equal or close to a frequency separation between the resonance frequencies to energize said piezolelectric vibrator with frequency-modulated waves to generate multifrequency audible sound.

In accordance with an aspect of the invention, said modulator circuit comprises a frequency divider circuit operative in response to an oscillating frequency in said oscillator circuit for dividing or counting down the oscillating frequency into the modulating frequency to modulate said oscillator circuit therewith.

In another aspect of the present invention, one of the resonance frequencies corresponds to a carrier frequency of the frequency-modulated waves, the other of the resonance frequencies corresponding to either of sideband frequencies of the frequency-modulated waves.

In another aspect of the present, said piezoelectric vibrator comprises a diaphragm, a metal sheet which is smaller in size than said diaphragm and mounted on said diaphragm, and a sheet of a piezoelectric material mounted on said metal sheet, said metal sheet which has the size in one direction not equal to the size in the direction perpendicular to the one direction. Advantageously, said metal sheet is generally rectangular, elliptical, or of any shape other than a circle.

BRIEF DESCRIPTION OF THE DRAWINGS

The objects and features of the present invention will become more apparent from a consideration of the following detailed description and the drawing in which.

DESCRIPTION OF THE PREFERRED EMBODIMENTS

Figure 1:
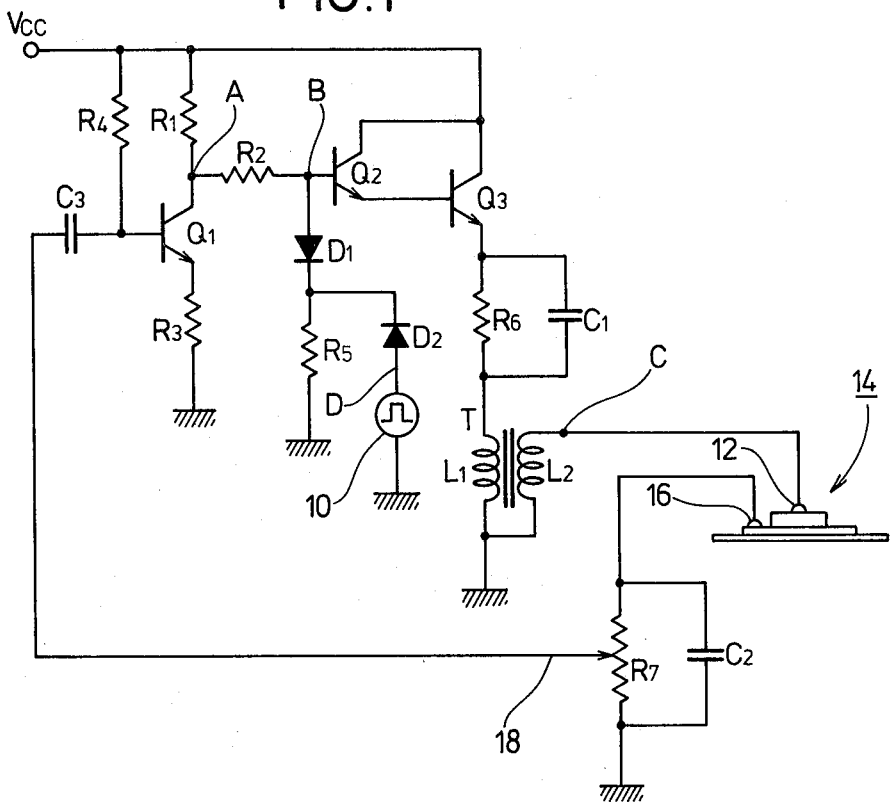
FIG. 1 is a schematic circuit diagram showing a preferred embodiment of a piezoelectric horn system in accordance with the present invention.

FIG. 1 shows, in a schematic circuit diagram, a preferred embodiment of a multifrequency piezoelectric horn system in accordance with the present invention, which includes transistors Q1, Q2 and Q3. The collector electrode A of transistor Q1 is connected through a resistor R1 to a reference voltage $V_{cc}$, and also through a resistor R2 to the base electrode B of transistor Q2. The emitter electrode of transistor Q1 is grounded via a resistor R3. Transistor Q1 has a base electrode coupled to a resistor R4 to be biased with reference voltage $V_{cc}$. Transistors Q2 and Q3 have collector electrodes coupled in common to reference voltage $V_{cc}$. The emitter electrode of transistor Q2 is coupled to the base electrode of transistor Q3. Both transistors Q2 and Q3 set up a so-called Darlington connection to function as a power amplifier. It may therefore be noted that transistor Q1, together with resistors R1 through R4, forms a preamplifier to Darlington amplifier Q2 and Q3.

Figure 2:
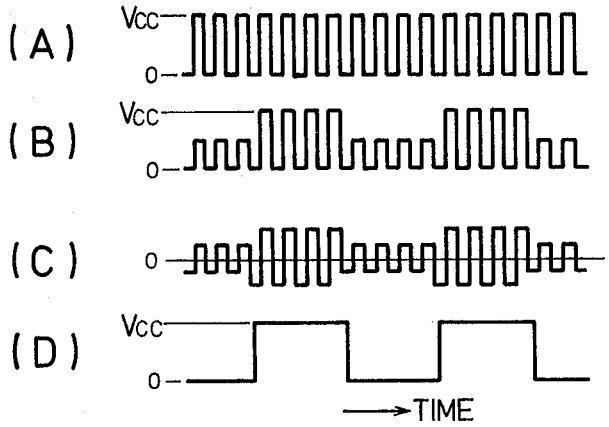
FIG. 2 shows the waveforms appearing at the points of the system shown in FIG. 1.

The base electrode B of transistor Q2 is coupled to the anode of a diode D1, whose cathode is grounded through a resistor R5 and also interconnected to the cathode of another diode D2. Diode D2 has an anode coupled to an output port D of a frequency oscillator 10, of which the other port is connected to ground. Frequency oscillator 10 may, preferably, be a pulse generator that produces square or rectangular pulses going up and down between two possible states, such as ground and reference level $V_{cc}$, as depicted in FIG. 2(D).

Transistor Q3 has an emitter electrode interconnected to one port of a parallel-coupled resistor R6 and a capacitor C1, the other port of which is coupled to one terminal of a primary winding L1 of a transformer T, of which the other terminal is grounded. Transformer T includes a secondary winding L2, of which one terminal is also grounded as seen in FIG. 1, and the other terminal of which is connected to one electrode 12 of a piezoelectric vibrator 14. Secondary winding L2 of transformer T has more turns than winding L1 so as to produce sufficiently high voltage to energize vibrator 14.

Vibrator 14, which functions as, for example, a horn for automobiles and will later be discussed in detail, has the other electrode 16 connected to one port of a parallel connection of a potentionmeter R7 and a capacitor C2. The other port of the parallel-coupled potentiometor R7 and capacitor C2 is grounded. Potentiometor R7 has a wiper 18, which is slidable over the full length of the resistor included therein to produce variable voltage thereon and of which the arm is interconnected through a capacitor C3 to the base electrode of transistor Q1.

Figure 3A:
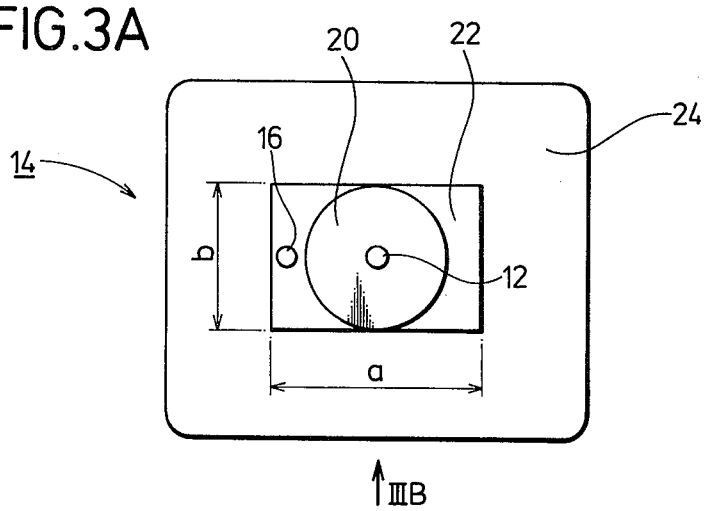
FIGS. 3A and 3B are, respectively, a plan and a side view of a piezoelectric vibrator for use in the system shown in FIG. 1.
Figure 3B:
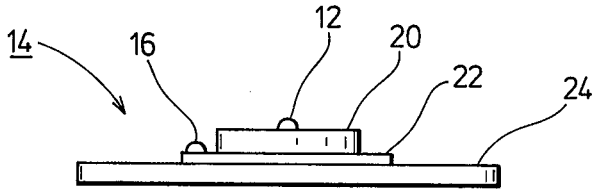

For the purpose of applications to automobile horns, piezoelectric vibrator 14 preferably generates audible sound of two or three different frequencies. In other words, vibrator 14 has two or three resonance frequencies. To this end, vibrator 14 of the type shown in FIG. 3A may advantageously be used. Piezoelectric vibrator 14, illustrated in FIGS. 3A and 3B, has a circular sheet 20 of a piezoelectric substance, such as ceramics of zircon-lead titanate that is permanently polarized perpendicularly to the primary surface of the sheet 20. Circular sheet 20 is attached with a suitable adhesive agent to a rectangular metal sheet 22, as clearly seen in FIG. 3B. Metal sheet 22, together with piezoelectric sheet 20, is also mounted with a suitable adhesive on a rectangular diaphragm 24, which is drawn to a rectangular shape analogeous to the shape of metal sheet 22 to form a vibrating plate emitting loud sound. In order for vibrator 14 to generate two different tones, i.e. two peaks of sound energy at different frequencies f1 and f2 as plotted in FIG. 4, it is important to shape metal sheet 22, and hence diaphragm 24, with its length a not equal to its width b. One of our experiments has revealed that vibrator 14 including metal sheet 22 of 40 millimeters long and 36 millimeters wide involves approximately four hundred hertz of frequency distance $\Delta f$ between two peaks of sound energy.

Figure 5A:
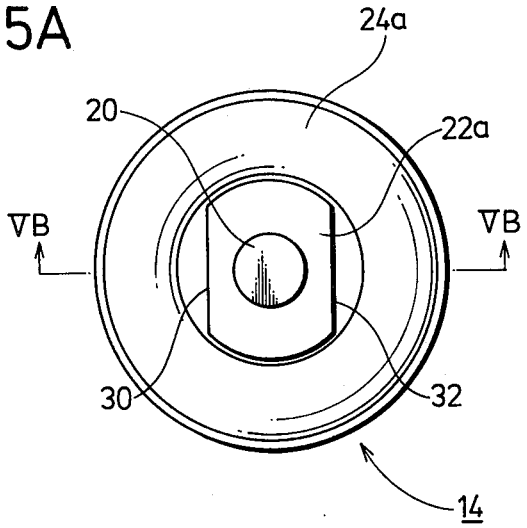
FIGS. 5A and 5B are, respectively, a plan and a side view of another piezoelectric vibrator for use in the system shown in FIG. 1.
Figure 5B:
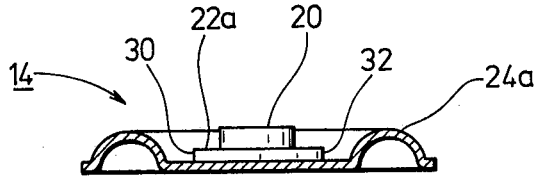

FIGS. 5A and 5B depict an alternative ambodiment of piezoelectric virbator 14 applicable to a multifrequency horn system in accordance with the present invention, and in the figures the like elements are designated by the like reference numerals used for the embodiments discussed above. Vibrator 14 shown in FIGS. 5A and 5B is composed of a circular sheet 20 of a piezoelectric substance, such as ceramics of zircon-lead titanate permanently polarized in a direction perpendicular to the primary surface of sheet 20, a generally circular metal sheet 22*a* which has opposite sides 30 and 32 cut out in parallel, and a circular diaphragm 24*a*, of which the surface cut out along the dot-and-dash line VB—VB shown in FIG. 5A is illustrated in FIG. 5B. Diaphragm 24*a* is appropriately drawn to be shaped into a disk with its periphery curved in section as shown in FIG. 5B. Metal sheet 22*a* is generally circular as discussed later and has a diameter which is longer than that of piezoelectric circular sheet 22 but not exceeding that of diaphragm 24*a*. Piezoelectric sheet 20, metal plate 22*a* and diaphragm 24*a* are attached to each other in this order with the centers thereof common as illustrated in FIG. 5A with a suitable adhesive agent.

Figure 4:
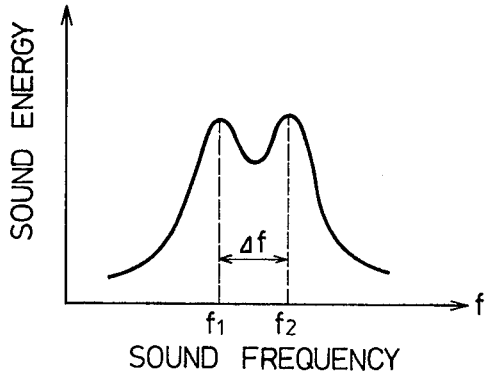
FIG. 4 plots the exemplary frequency characteristics of the sound energy of the vibrator shown in FIGS. 3A and 3B.
Figure 6:
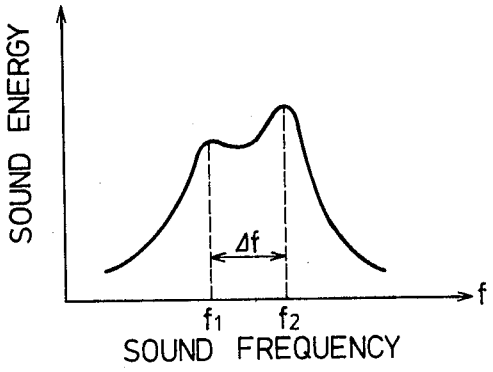
FIG. 6 plots exemplary frequency characteristics of the sound energy of the vibrator shown in FIGS. 5A and 5B.
Figure 7:
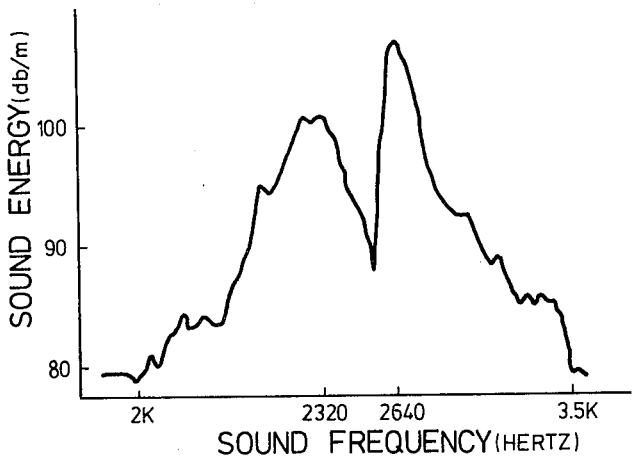
FIG. 7 depicts experimental sound energy levels in terms of sound frequency measured on a sample of the piezoelectric vibrator of the type illustrated in FIGS. 5A and 5B.

Metal sheet or plate 22*a* is generally circular with its opposite sides 30 and 32 cut out in parallel, in other words, it is generally rectangular, as shown in FIG. 5A, so that it has two resonance frequencies f1 and f2 as plotted in FIG. 4, or has a broad band as illustrated in FIG. 6. In general, a resonance frequency $f_r$ of a piezoelectric vibrator made of a circular plate of radius r and thickness t follows the following expression:

$$f_r = \frac{\alpha t}{r^2}\sqrt{\frac{E}{3\rho(1-\sigma^2)}},$$

where E, $\rho$ and $\sigma$ are the Young's modulus, density and Poission's ratio, respectively, and $\alpha$ is a constant dependent upon a vibration mode, etc. Accordingly, the inclusion of generally-rectangular metal plate 22*a* in vibrator 14, i.e. of metal plate 22*a* which has the size in one direction not equal to the size in the direction perpendicular to the one direction, causes the term of $\sqrt{E/\rho}$ in the expression to be different in dependence upon the two vibration directions so that metal plate 14 has two resonance frequencies. The frequency characteristics of vibrator 14 having metal plate 22*a*, therefore, exhibits two distanct peaks in sound energy. In accordance with one of our experiments, the frequency characteristics of vibrator 14 of the type shown in FIG. 5A had two peaks in audible sound energy at separate frequencies 2,320 and 2,640 hertz, as plotted in FIG. 7.

Figure 8A:
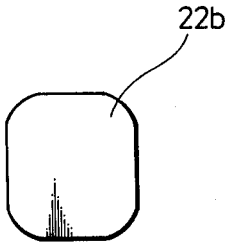
FIGS. 8A, 8B and 8C illustrate, in plan views, examples of metal sheets included in the vibrator shown in FIGS. 5A and 5B.
Figure 8B:
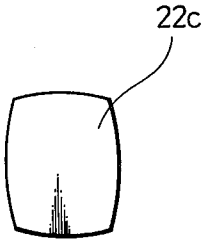
Figure 8C:
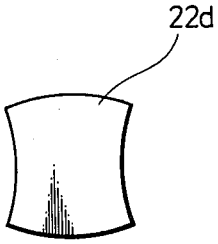

In accordance with the invention, in order to resonate vibrator 14 at at least two separate frequencies, it is sufficient to shape metal sheet 22*a* with its width different from its length, in other words, with its size in one direction not equal to its size in the other direction perpendicular to the one direction. Therefore, metal sheets 22*b*, 22*c* and 22*d* illustrated in the plan views in FIGS. 8A, 8B and 8C, respectively, of the shapes, such as a general rectangle and a general ellipse, other than a circle are advantageously applicable to vibrator 14.

Figure 9:
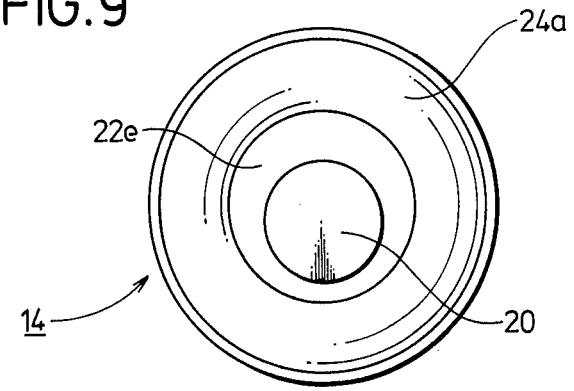
FIG. 9 is a plan view showing another example of the vibrator for use in the piezoelectric horn in accordance with the invention.

Alternatively, vibrator 14 may include a circular metal disk 22*e* see FIG. 9, which supports piezoelectric disk 20 thereon with the centers thereof displaced to each other so as to cause the term $\sqrt{E/\rho}$ in the aforementioned expression to be dependent upon the directions on the primary surface of metal disk 22*e*.

Now returning to FIG. 1, it is assumed that vibrator 14 has two resonance frequencies f1 and f2, as shown in FIG. 4. In operation, power amplifier Q2 and Q3 energizes primary winding L1 of transformer T to induce a higher voltage across secondary winding L2 thereof. The induced voltage is applied to the serial connection of vibrator 14 and parallel-coupled resistor R7 and capacitor C2 to actuate vibrator 14, and to produce a voltage across potentiometer R7, a part of which voltage is positively fed back to the base electrode of transistor Q1 by way of capacitor C3. Consequently, the total circuitry of FIG. 1 will oscillate by itself at one of the frequencies f1 and f2. The oscillating waveforms appearing at the collector electrode A of transistor Q1 is shown in FIG. 2(A).

As described earlier, pulse generator 10 produces square pulses as shown in FIG. 2(D). Diode D1, whose anode is coupled to the base electrode B of transistor Q2, turns on in response to negative-going edges of the square pulses, FIG. 2(D), from oscillator 10 to conduct the base current of transistor Q2 to the ground via enabled diode D1 and resistor R5. In response to positive-going edges of the output pulses from oscillator 10, diode D1 becomes nonconductive to exclude resistor R5 from the base electrode B of transistor Q2. Consequently, the self-oscillating pulses, FIG. 2(A), will be modulated in amplitude with the square waves, FIG. 2(D), produced by oscillator 10. Such amplitude-modulated waveforms appearing at the base electrode B of transistor Q2 are shown in FIG. 2(B). The modulated waveforms are amplified in power by the power amplifier including transistors Q2 and Q3 to actuate primary winding L1 of transformer T. The amplitude-molulated waveforms from which the d.c. components thereof have been removed by transformer T appear at one terminal C of secondary winding L2 to drive vibrator 14. The driving waveforms at terminal C is depicted in FIG. 2(C).

Figure 10:
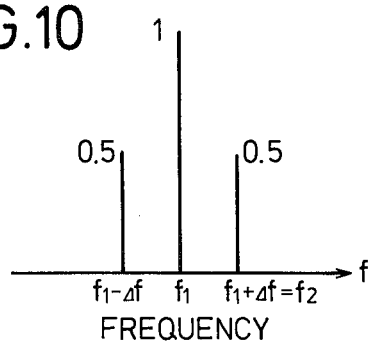
FIG. 10 depicts a frequency spectrum useful for understanding the operation of the horn system illustrated in FIG. 1.

If the total system shown in FIG. 1 oscillates by itself at frequency f1, FIG. 4, that is, the waveforms, FIG. 2(A), appearing at the collector electrode A of transistor Q1 includes primarily frequency f1, and if pulse generator 10 oscillates at frequency $\Delta f$, namely, the pulsing rate of the waveforms, FIG. 2(D), produced from generator 10 is $\Delta f$, then the frequency spectrum of the modulated waves, FIG. 2(C), is such that the carrier frequency is f1 and the sideband frequencies are $f1 \pm \Delta f$, as illustrated in FIG. 10, in which the ordinate indicates normalized amplitude. It may easily be noted that the upper sideband frequency $f1+\Delta f$ corresponds to the other peak frequency f2, FIG. 4. It is to be noted that if the FIG. 1 system oscillates naturally at frequency f2, then the frequency spectrum of the amplitude-modulated waves is such that the carrier frequency is of course f2 and the lower sideband frequency is $f2-\Delta f$, which corresponds to the one peak or resonance frequency f1 of vibrator 14. In accordance with the invention, it is preferable to design the piezoelectric horn system shown in FIG. 1 so as to make the modulating frequency generated from oscillator 10 substantially or approximately equal to the separation $\Delta f$ between the two resonance frequencies f1 and f2 of vibrator 14. Advantageously, the modulating frequency is less than 1 kilohertz, and preferably from 200 to 500 hertz for automobile horns.

Figure 11:
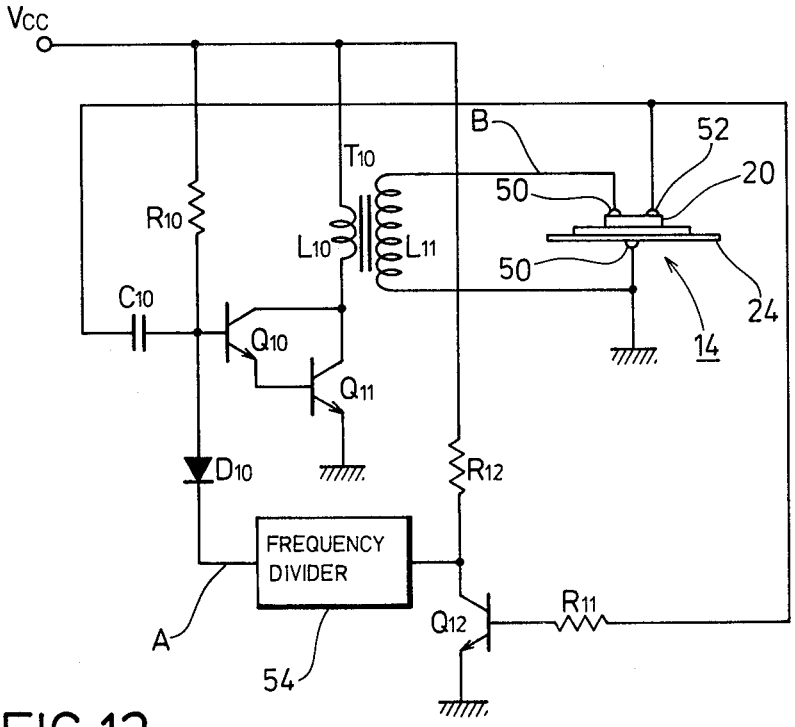
FIG. 11 shows, in a schematic circuit diagram, another embodiment of the piezoelectric horn system in accordance with the present invention.

Another illustrative embodiment of the piezoelectric horn system in accordance with the present invention is shown in FIG. 11 in the form of a schematic circuit diagram. The circuitry shown in FIG. 11 also includes Darlington-coupled transistors Q10 and Q11, of which the collector electrodes are in common coupled to one terminal of a primary winding L10. The other terminal of primary winding L10 is connected to a power source $V_{cc}$, that may be a battery carried on a car. The emitter electrode of transistor Q10 is interconnected to the base electrode of transistor Q11, which has an emitter electrode grounded.

Transformer T10 includes a secondary winding L11, whose one terminal is grounded and the other terminal is connected to one of energizing electrodes 50 of piezoelectric vibrator 14. One of energizing electrodes 50 is mounted on piezoelectric material sheet 20, and the other is mounted on diaphragm 24. The latter electrode is grounded to earth. Piezoelectric sheet 20 also carries another electrode 52 as a feedback electrode, that is connected to the base electrode of transistor Q10 by way of a capacitor C10 to form a positive feedback path for the amplifier including transistors Q10 and Q11. The base electrode of transistor Q10 is connected through a resistor R10 to reference voltage $V_{cc}$.

Secondary winding L11 of transformer T10 has much more turns than that of primary winding L10 to induce an enhanced voltage thereon, which is in turn applied to the pair of energizing electrodes 50 to drive vibrator 14. Feedback electrode 52 picks up a part of the voltage across vibrator 14 to feed it back positively to the input of Darlington amplifier Q10 and Q11, and also to supply it to a wave shaping circuit including a transistor Q12, as discussed later.

Feedback electrode 52 of vibrator 14 is also interconnected to the base electrode of a transistor Q12 through a resistor R11. Transistor Q12 has an emitter electrode grounded and a collector electrode fed from power source $V_{cc}$ via a resistor R12. The collector output from transistor Q12 is also connected to an input port of a frequency divider 54. The circuit composed of transistor Q12, and resistors R11 and R12 serves to shape the output voltage across feedback electrode 52 of vibrator 14 into square pulses to provide them to frequency divider 54. Frequency divider 54 produces on its output port A pulses of which the pulse rate is divided or counted down to 1/N of that of the input pulses thereto. The output from divider 54 is fed to the base electrode of transistor Q10 through a diode D10.

Figure 12:
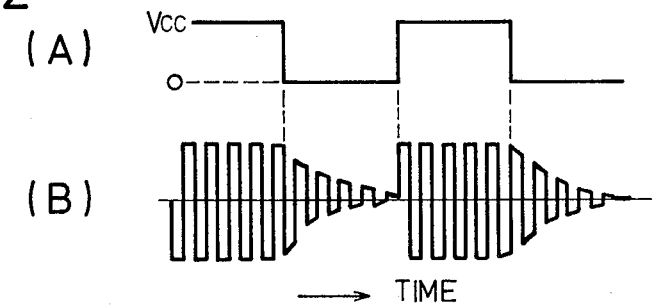
FIG. 12 depicts the waveforms appearing at the points of the circuitry shown in FIG. 11.

In operation, since vibrator 14 has two resonance frequencies f1 and f2, as depicted in FIG. 4, the total circuitry shown in FIG. 11 is caused to oscillate naturally at either of those resonance frequencies f1 and f2. With this instance, frequency divider 54 is designated to divide or count down the input frequency, f1 or f2, derived from transistor Q12 into 1/N so to produce the output pulses at port A which include the primary frequency that is approximately or substantially equal to the frequency separation $\Delta f$ between the adjacent energy peaks of sound, as shown in FIG. 12(A). Diode D10 takes its conductive state during the periods of the high level of the output pulses of frequency divider 54 and takes its nonconductive state during the low level periods of the output pulses. In other words, diode D10 turns on and off in synchronism with the output pulses from divider 54, and hence at the frequency substantially or approximately equal to $\Delta f$. During the time diode D10 is held in its nonconductive state, the oscillating circuitry including Darlington-coupled transistors Q10 and Q11 generates pulses at either of the resonance frequencies f1 and f2, and during the on-state of diode D10 such natural oscillation is forced to attenuate because of the lower level appearing by way of conducted diode D10. The self-oscillating pulses are therefore caused to be modulated in amplitude with the divided frequency produced by frequency divider 54, as shown in FIG. 12(B). Therefore, as discussed above, the frequency-modulated signals, FIG. 12(B), has such a frequency spectrum that its carrier frequency is equal to one of the resonance frequencies f1 and f2, and its sideband frequencies are equal to the other of the resonance frequencies plus or minus frequency separation Δf. If the natural or self oscillating frequency is f1, the upper sideband frequency f1+Δf is equal to f1+(f1/N), that is equal to f2, and vice versa.

In accordance with the latter embodiment of the invention, since the modulating pulses, FIG. 12(A), for Darlington amplifier Q10 and Q11 is frequency-divided from one of the resonance frequencies f1 and f2, they are completely in phase with the one resonance frequency. This is much more effective to cause vibrator 14 to produce clear sound which is felt confortable to the ear. According to our experiments, a horn system was designed to oscillate at 2,400 hertz, and frequency divider 54 was designed to divide the input frequency by 12 (N=12). The audible sound of 2,400 hertz modulated with 200 hertz was measured at the energy level of 115 db at the distance of one meter in front of the vibrator 14. It was clear sound without noise that would otherwise harsh to the ear.

While the present invention has been described in terms of specific illustrative embodiments, it is to be understood to be susceptible of modification by those skilled in the art within the spirit and scope of the appended claims.

What we claim is:

1. Multifrequency piezoelectric sound-generating apparatus comprising:

a piezoelectric vibrator for generating audible sound at at least first and second distinct resonance frequencies;

an oscillator circuit connected to said piezoelectric vibrator for oscillating at said first resonance frequency; and a modulator circuit connected to said oscillator circuit for amplitude-modulating said oscillator circuit with a modulating frequency substantially equal or close to the frequency separation between said first and second resonance frequencies to energize said piezoelectric vibrator with frequency-modulated waves to generate multifrequency audible sound.

2. The apparatus of claim 1, wherein said modulator circuit comprises a local oscillator for generating said modulating frequency.

3. The apparatus of claim 2, wherein said local oscillator generates square pulses at a pulse rate corresponding to the modulating frequency.

4. The apparatus of claim 1, wherein said modulator circuit comprises a frequency divider circuit operative in response to an oscillating frequency in said oscillator circuit for dividing the oscillating frequency into the modulating frequency to modulate said oscillator circuit therewith.

5. The apparatus of claim 4, wherein said modulator circuit comprises a wave shaper circuit connected to said oscillator circuit for shaping the oscillating frequency into square pulses to provide said frequency divider circuit with the square pulses, said frequency divider circuit being adapted to produce frequency-divided square pulses as the modulating frequency.

6. The apparatus of claim 1 or 4, wherein said first resonance frequency corresponds to a carrier frequency of the frequency-modulated waves, the second resonance frequency corresponding to either of the sideband frequencies of the frequency-modulated waves.

7. The apparatus of claim 1 or 4, wherein said piezoelectric vibrator comprises a diaphragm, a metal sheet which is smaller in size than said diaphragm and mounted on said diaphragm, and a sheet of a piezoelectric material mounted on said metal sheet, said metal sheet having a dimension in a first direction that differs from a dimension in a second direction that is perpendicular to said first direction.

8. The apparatus of claim 7, wherein said metal sheet is generally rectangular.

9. A multifrequency piezoelectric horn for use in automobiles comprising:

a piezoelectric vibrator for generating audible sound at at least first and second distinct resonance frequencies;

said piezoelectric vibrator comprising a diaphragm, a metal sheet which is smaller in size than said diaphragm and mounted on said diaphragm, and a sheet of a piezoelectric material mounted on said metal sheet, said metal sheet being generally rectangular;

an oscillator circuit connected to said piezoelectric vibrator for oscillating at said first resonance frequency; and a modulator circuit connected to said oscillator circuit for amplitude-modulating said oscillator circuit with modulating pulses which have a repetition rate substantially equal or close to the frequency difference between said first and second resonance frequencies;

whereby said piezoelectric vibrator is energized with frequency-modulated waves to generate multifrequency audible sound.

10. A horn in accordance with claim 9, wherein said modulator circuit comprises a wave shaper circuit connected to said oscillator circuit for shaping oscillating pulses in said oscillator circuit into square pulses, and a frequency divider circuit operative in response to the square pulses for dividing the square pulses into the modulating pulses to modulate said oscillator circuit therewith.

* * * * *